US009593598B2

(12) United States Patent
Bapat et al.

(10) Patent No.: US 9,593,598 B2
(45) Date of Patent: Mar. 14, 2017

(54) STEAM CONDITIONING SYSTEM

(71) Applicant: Holtec International, Marlton, NJ (US)

(72) Inventors: Akhilesh Vidyutkumar Bapat, Evesham, NJ (US); Indresh Rampall, Cherry Hill, NJ (US); Vytautas Vincas Maciunas, Cherry Hill, NJ (US)

(73) Assignee: Holtec International

( * ) Notice: Subject to any disclaimer, the term of this patent is extended or adjusted under 35 U.S.C. 154(b) by 106 days.

(21) Appl. No.: 14/710,852

(22) Filed: May 13, 2015

(65) Prior Publication Data

US 2015/0330260 A1 Nov. 19, 2015

Related U.S. Application Data

(60) Provisional application No. 61/992,625, filed on May 13, 2014.

(51) Int. Cl.
*F22G 5/12* (2006.01)
*F01K 17/04* (2006.01)
(Continued)

(52) U.S. Cl.
CPC ..... *F01K 17/04* (2013.01); *F01K 3/18* (2013.01); *F01K 9/003* (2013.01); *F22G 5/12* (2013.01);
(Continued)

(58) Field of Classification Search
CPC ... F01K 9/003; F22G 5/00; F22G 5/12; B01D 19/0042
(Continued)

(56) References Cited

U.S. PATENT DOCUMENTS 1,774,114 A 4/1930 Vandeveer
1,896,247 A * 2/1933 Rudorff ..... F22G 5/12 122/459
(Continued)

FOREIGN PATENT DOCUMENTS

| | | |
|---|---|---|
| CN | 203797633 | 8/2014 |
| DE | 826299 | 12/1951 |
| DE | 1124511 | 3/1962 |

OTHER PUBLICATIONS

Nadig, et al., "Admission of Bypass Steam into a Water Cooled Condenser and Air Cooled Condenser. Similaries, Differences and Areas of Concern", Jul. 28-31, 2014, pp. 1-6, Baltimore, Maryland, ASME.
(Continued)

*Primary Examiner* — Robert A Hopkins
(74) *Attorney, Agent, or Firm* — The Belles Group, P.C.

(57) ABSTRACT

A steam conditioning system for discharging bypass steam into a condenser of a steam powered generating plant and other uses. The system includes a steam conditioning device comprising an inner evaporative core and an outer shell. The core may be formed of a tubular piping section disposed at least partially inside the outer shell forming an annular space therebetween. An inlet end of the core receives steam from a piping header fluidly connected to an upstream desuperheating pressure reducing station which injects liquid coolant into the steam stream. Steam discharges through the core outlet end into the outer shell, reverses direction, and flows into the condenser. In one embodiment, the steam conditioning device may be disposed inside the dome of the condenser except for the inlet end. The device intends to increase flow residence time to evaporate entrained carryover coolant droplets in the incoming steam before release to the condenser.

24 Claims, 7 Drawing Sheets

(51) Int. Cl.

| | |
|---|---|
| ***F01K 9/00*** | (2006.01) |
| ***F01K 3/18*** | (2006.01) |
| ***F28B 9/02*** | (2006.01) |
| ***F28B 1/02*** | (2006.01) |

(52) U.S. Cl.
CPC ..... *F28B 1/02* (2013.01); *F28B 9/02* (2013.01); *F28F 2250/06* (2013.01); *F28F 2265/00* (2013.01)

(58) Field of Classification Search
USPC ..... 122/406.1, 459; 96/204
See application file for complete search history.

(56) References Cited

U.S. PATENT DOCUMENTS

| | | | | |
|---|---|---|---|---|
| 2,910,275 | A | 10/1959 | Munro | |
| 3,085,056 | A | 4/1963 | Whitelaw | |
| 3,291,105 | A * | 12/1966 | Stenard | B01D 19/001 122/406.1 |
| 3,490,521 | A | 1/1970 | Byerley | |
| 4,220,194 | A | 9/1980 | Shade et al. | |
| 4,315,559 | A | 2/1982 | Casey | |
| 4,372,125 | A | 2/1983 | Dickenson | |
| 4,425,762 | A | 1/1984 | Wakamatsu et al. | |
| 4,718,456 | A | 1/1988 | Schoonover | |
| 4,778,005 | A | 10/1988 | Smith | |
| 4,873,829 | A | 10/1989 | Williamson | |
| 6,276,442 | B1 | 8/2001 | Rasmussen | |
| 6,467,570 | B1 | 10/2002 | Herold | |
| 7,121,906 | B2 | 10/2006 | Sundel | |
| 2002/0023739 | A1 | 2/2002 | Wagner et al. | |
| 2004/0177613 | A1 | 9/2004 | DePenning et al. | |
| 2005/0045416 | A1 | 3/2005 | McCarty | |
| 2012/0210713 | A1 | 8/2012 | Ernst et al. | |
| 2013/0199649 | A1 | 8/2013 | Fitzgerald | |

OTHER PUBLICATIONS

Corresponding International Search Report and Written Opinion for PCT/US15/30490 dated Aug. 4, 2015.

* cited by examiner

STEAM CONDITIONING SYSTEM

CROSS-REFERENCE TO RELATED APPLICATIONS

This application claims the benefit of U.S. Provisional Application No. 61/992,625 filed May 13, 2014, which is incorporated herein by reference in its entirety.

BACKGROUND

The present invention relates generally to steam power generating plant, and more particularly to an apparatus and system for drying desuperheated steam useful in a main steam dump system.

Fossil fuel and nuclear steam power generating plants employ the Rankine cycle to convert steam energy into electric power. In the Rankine cycle, superheated steam is produced in a steam generator or boiler which feeds a turbine coupled to an electric generator that produces electricity. The steam cools and loses its superheat as it passes through the high and low pressure sections of the turbine before being exhausted to a condenser, typically a shell and tube steam surface condenser. Circulating water flows through the tube side which cools and condenses the hot steam flowing on the shell side of the condenser. The liquid condensate is collected and returned to steam generator to continue the cycle.

A steam surface condenser in a combined cycle or power plant requires the condenser to sometimes be operated in bypass mode. Bypass operation can occur during a unit start up or during turbine trips during which time the turbine cannot accept main steam flow from the steam generator. High energy superheated steam generated by the steam generator or boiler bypasses the turbine and is directly dumped into the steam surface condenser.

The HEI (Heat Exchange Institute) recommends pressure and enthalpy ranges for the dumping steam. A desuperheating station comprising a desuperheating pressure reducing valve is typically employed to bring the pressure down under 250 psia and enthalpy under 1225 BTU/lb. prior to entering the condenser. The EPRI (Electric Power Research Institute) guidelines are also widely used industry standards in designing these high energy dissipation devices, which are installed in piping runs called bypass steam headers.

Steam conditioning is critical for safe energy dissipation inside a condenser. Condensers operate at near vacuum conditions (e.g. 1-2" Hga) at the time bypass mode operation commences. This causes steam to exit at sonic conditions inside the condenser. A small carryover of water droplets that have not had time to evaporate in the surrounding superheated steam can cause significant damage to the condenser internals by wet steam erosion. The effect of wet steam damage has been widely documented.

A typical desuperheating and pressure-reducing station used in steam bypass headers uses spray cooling water such as condensate which is mixed with and desuperheats the steam. Standard design practice is to place the station far enough away from the condenser so that complete evaporation of the water sprayed to accomplish desuperheating has enough time to evaporate in the bypass header piping before reaching the condenser inlet nozzle. Sufficient residence time is required to ensure 100% evaporation of the spray water for minimizing the effects of wet steam erosion. Conversely, if the location of the desuperheating station is too close to the condenser, there may not be enough time to allow for proper mixing and evaporation of the spray water inside the piping before steam exits at high velocity into the neck or dome of the condenser. In such a case, the entrained water droplets can cause significant damage to the condenser internals. Accordingly, the lengthy run of bypass header piping necessary to provide satisfactory residence time for evaporating the entrained water piping can often be difficult to accommodate in the space available within the power plant without interfering with the many other auxiliary systems and equipment used.

An improved approach to handling bypass steam flow to the steam surface condenser is desired.

BRIEF SUMMARY

A novel approach to designing a steam conditioning device useable in a bypass steam application is provided that increases the effective distance of the desuperheating station from the point of exit into the condenser neck or dome by incorporating an integral evaporative core within the bypass header. The bypass steam conditioning device is configured to increase the residence time of the desuperheated steam flow to allow for total or near total evaporation of any entrained water droplets within a relatively short length of piping. Advantageously, this allows the length of bypass steam header piping between the desuperheating and pressure-reducing station and condenser to be minimized, thereby conserving valuable space within the power plant.

In one aspect, a steam conditioning system includes: a condenser defining an interior region; a steam conditioning device comprising an assembly of: an inner evaporative core comprising a tubular section defining a longitudinal axis, the tubular section including an inlet end configured for coupling to a steam piping header and a terminal outlet end; and an outer shell formed around the inner evaporative core, the outer shell including a first head, an opposing closed second head, cylindrical sidewalls extending between the first and second heads, and an internal cavity receiving the inner evaporative core at least partially therein through the first head; a longitudinally extending annular space formed between the inner core and outer shell; wherein the outer shell is in fluid communication with the condenser and arranged to receive steam from the inner core and discharge the steam into the interior region of the condenser.

In another aspect, a steam dissipate system includes: a condenser defining an interior region; a steam conditioning device comprising an assembly of: an inner evaporative core comprising a tubular section defining a longitudinal axis, the tubular section including an inlet end configured for coupling to a steam piping header and a terminal outlet end; an outer shell formed around the inner evaporative core, the outer shell including a first head, an opposing closed second head, cylindrical sidewalls extending between the first and second heads, and an internal cavity receiving the inner evaporative core at least partially therein through the first head; a longitudinally extending first annular space formed between the inner core and outer shell; a hollow cylindrical annular shroud disposed in the internal cavity of the outer shell, the shroud including an open end and an opposing closed third head that defines a flow plenum, the inner evaporative core at least partially inserted into the shroud which is arranged to receive steam from the inner evaporative core; a longitudinally extending second annular space formed between the inner core and annular shroud, the second annular space in fluid communication with the inner evaporative core and the internal cavity of the outer shell; an interconnected steam flow path formed between the inner evaporative core, annular shroud, and outer shell; wherein the outer shell is in fluid communication with the condenser and arranged to receive steam from the inner core via the annular shroud, and discharge the steam into the interior region of the condenser.

A method for discharging steam into a condenser is provided. The method includes: providing an axially elongated steam conditioning device including a tubular shaped inner evaporative core having an inlet end and an opposite outlet end disposed inside a cylindrical outer shell having a first head and an opposite second head, the steam conditioning device defining a longitudinal axis and axial direction; the inlet end of the evaporative core receiving steam from a desuperheating pressure reducing station; discharging the steam from the inner evaporative core through the outlet end into an internal cavity of the outer shell; and discharging the steam from the outer shell into the condenser.

Further areas of applicability of the present invention will become apparent from the detailed description provided hereinafter, which includes the drawings.

BRIEF DESCRIPTION OF THE DRAWINGS

The present invention will become more fully understood from the detailed description and the accompanying drawings, wherein like elements are labeled similarly and in which.

Figure 1:
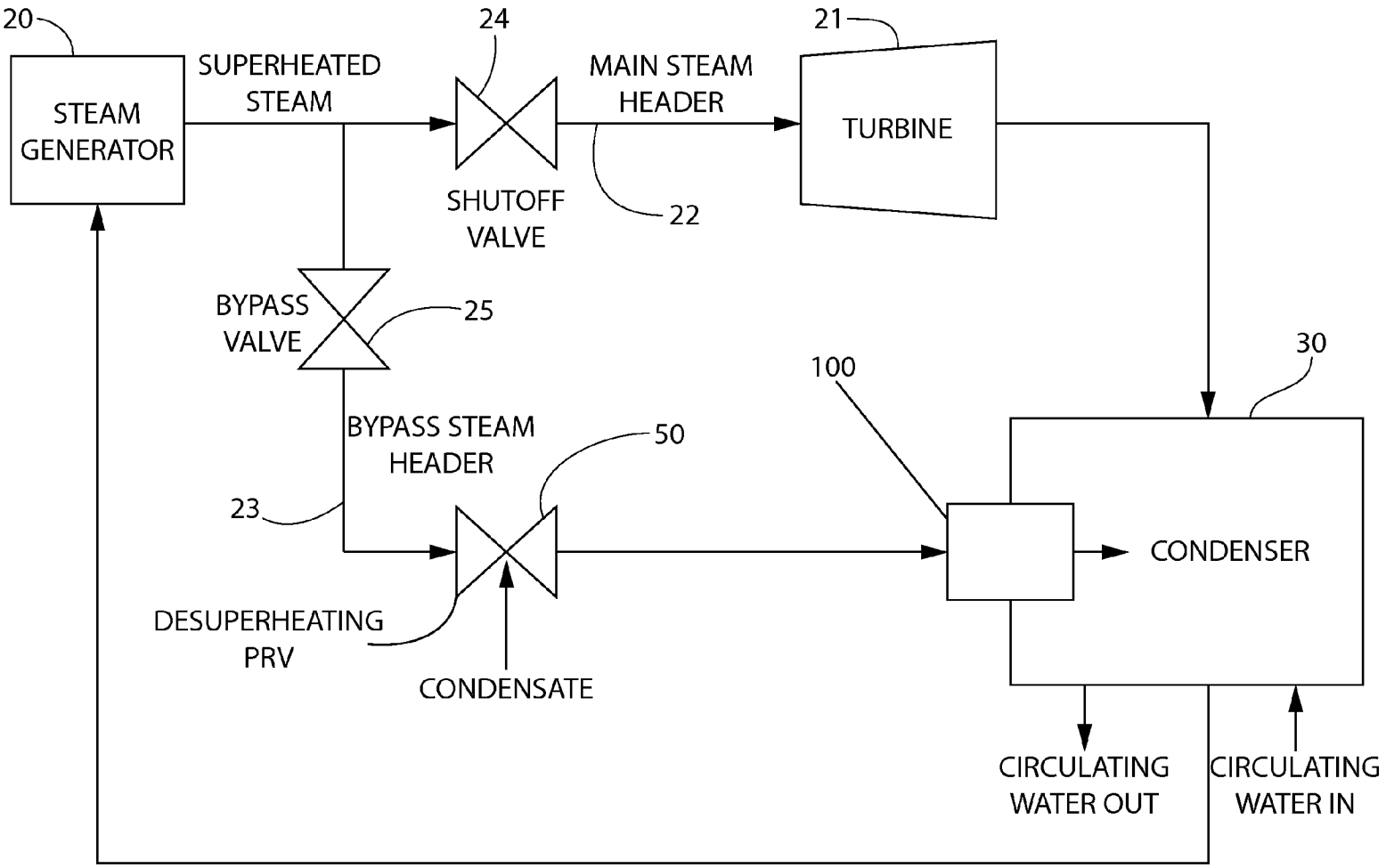
FIG. 1 is a schematic flow diagram of steam flow in a steam powered generating plant including a bypass steam conditioning device according to the present disclosure.

All drawings are schematic and not necessarily to scale.

DETAILED DESCRIPTION

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

As used throughout, any ranges disclosed herein are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Figure 3:
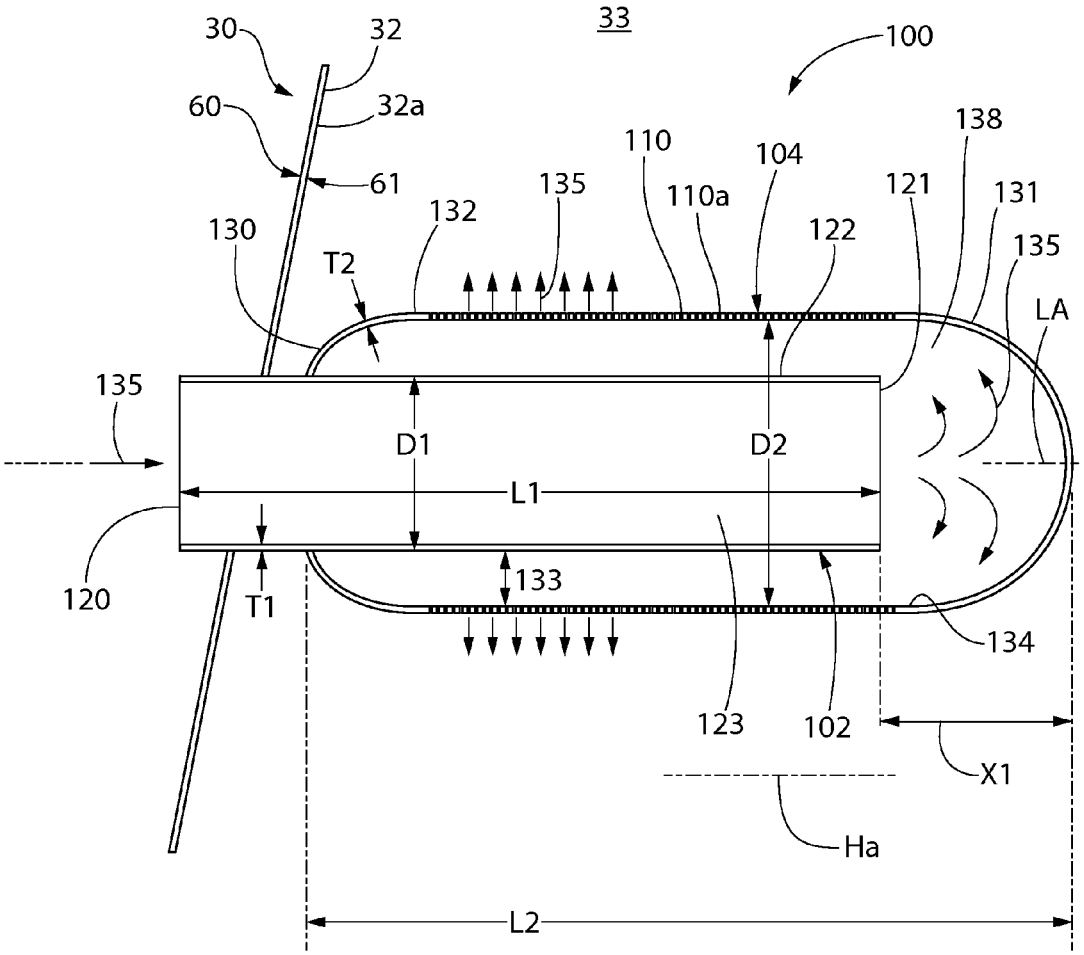
FIG. 3 is a longitudinal cross-sectional elevation view of a first embodiment of the steam conditioning device of FIGS. 1 and 2.

FIG. 3 shows details of the steam bypass header design with an integral inner evaporative core 102 and outer shell 104 forming a bypass steam conditioning device 100 according to the present disclosure. The inner evaporative core 102, which may be configured and formed of a tubular piping section, essentially acts as an extension of the bypass header piping to which the core is fluidly connected. In some embodiments, the inner evaporative core 102 may therefore have the same internal diameter as the bypass header piping and forms an integral continuation of the bypass header, or it may be different in diameter (i.e. larger or smaller).

The inner evaporative core 102 of the bypass steam conditioning device 100 accordingly extends the effective length of the bypass header, and advantageously improves performance for evaporating any entrained water droplets remaining in the bypass steam downstream of the desuperheating pressure reducing valve (PRV) station. Inside the bypass steam conditioning device 100, the now presumably dry steam exits the inner evaporative core 102 and makes a 180 degree turn around or reversal in flow direction to enter the annular region or space of the bypass steam conditioning device inside the outer shell 104 and surrounding the core. This arrangement further advantageously provides some additional residence time within the bypass steam conditioning device to evaporate any residual water droplets. The outer shell 104 has small orifice holes forming a sparger 110 for which the design is governed by EPRI Guidelines. The sparger creates the last steam pressure drop before the desupereheated bypass steam is discharged inside the condenser 30. The diameter of the evaporative core 102 and bypass sparger 110 are determined primarily on evaporation rate and header distribution efficiency. The steam exits the bypass steam conditioning device through the sparger and enters the interior of the condenser.

Figure 7:
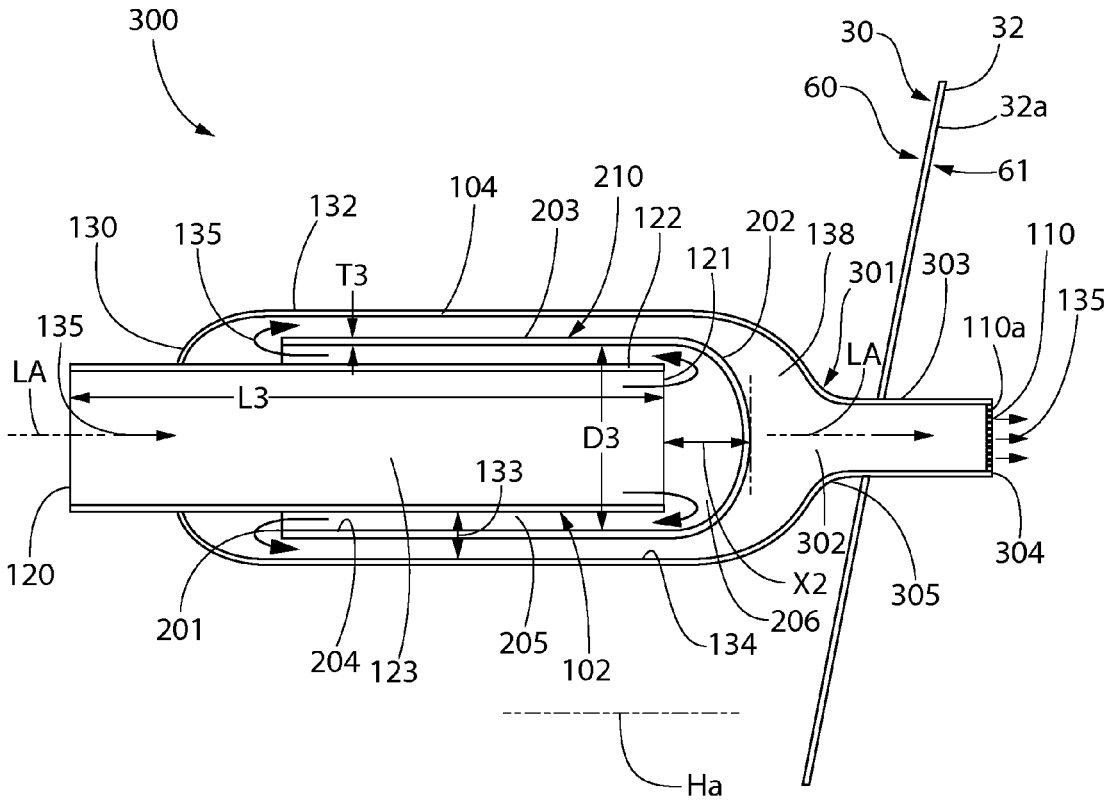
FIG. 7 is a longitudinal cross-sectional elevation view of a third embodiment of the steam conditioning device of FIGS. 1 and 2 which includes an annular shroud and outlet piping extension.

In the non-limiting arrangement shown in FIG. 3, the additional length of bypass header piping effectively formed by the inner evaporative core 102 may be disposed inside the condenser 30 (together with the outer shell 104). This enables the power plant designer to place the desuperheating PRV station relatively close to the condenser externally without compromising the superheat requirement of 25 F-75 F inside the condenser sparger as required by the governing HEI condenser standards. Furthermore, the increase in the effective length of the bypass header does not extend the length of the steam bypass header external to the condenser to conserve available plant space. In other possible constructions, however, the bypass steam conditioning device 100 may be located externally to the condenser as shown in FIG. 7 and further described herein.

The bypass steam conditioning device and arrangement with respect to the power plant steam system will now be described in greater detail.

FIG. 1 is a schematic diagram showing the steam flow in one non-limiting example of a power generating plant steam system. Major components of the system include a steam generator 20, turbine 21, and condenser 30 interconnected via piping runs (headers). Superheated steam leaves the steam generator 20 which may be nuclear or fossil fuel based (e.g. oil, natural gas, coal, biomass, etc.). Water is heated and boiled in the steam generator to produce steam at superheat conditions. During normal operation of the plant, superheated steam flows from the steam generator 20 to the turbine 21 through the main steam header 22. The turbine is coupled to an electric generator (not shown) for producing electricity. The steam exits the turbine 21 through an exhaust port (typically on the bottom adjacent to the last stages of blades in the low pressure section of the turbine) and enters the condenser 30 where the steam is condensed forming the liquid state condensate. In one embodiment, the condenser 30 may be a heat exchanger in the form of a surface condenser shown schematically in FIG. 2.

Surface condensers used in the foregoing application are shell and tube heat exchangers which are well known in the art and available from numerous commercial sources. Such designs share many common fabrication and component features, some of which are summarized herein.

Figure 2:
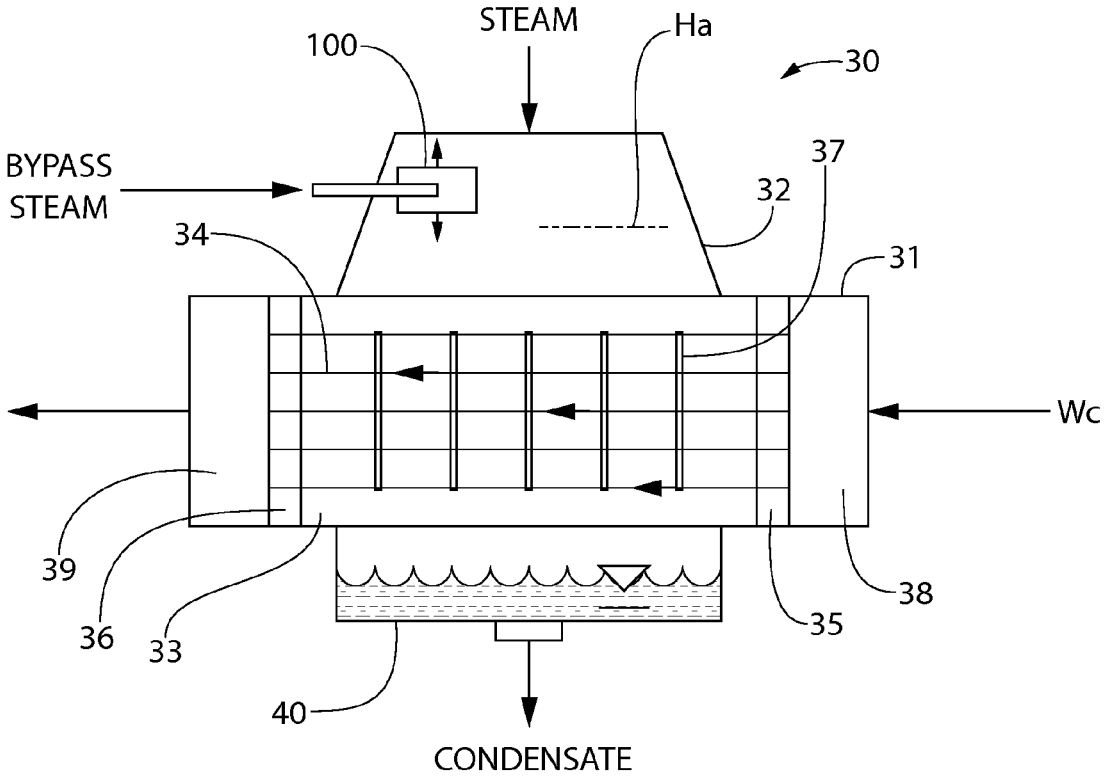
FIG. 2 is a schematic diagram of the surface condenser in FIG. 1.

Referring to FIGS. 1 and 2, surface condenser 30 generally includes an outer shell 31 and adjoining neck or dome 32 which defines an interior region 33. The dome 32 is positioned above the shell 31 and configured for fluid coupling to the turbine exhaust port. The interior region contains a plurality of horizontally oriented heat exchange tubes 34 which are supported at opposing terminal ends by a vertical inlet tubesheet 35 and outlet tubesheet 36. Portions of the tubes 34 between the tubesheets 35, 36 are supported by one or more vertically oriented tube support plates 37. An inlet water box 38 is formed between the shell 31 and inlet tubesheet 35. Similarly, an outlet water box 39 is formed between the shell and outlet tubesheet 36. Other arrangements and orientation of the foregoing components are possible.

On the tube side, circulating water We (which forms a heat sink for condensing the steam) enters the inlet water box 38, flows through the tubes 34 picking up heat from the steam, and enters the outlet water box 38. Heat is transferred from the hotter steam to the cooler circulating water through the tube walls, thereby removing heat and dropping the temperature of the steam to the point where it condenses forming the liquid condensate. The condensate is collected in a hotwell 40 at the bottom of the condenser 30 below the tubes 34. During normal operation of the power plant and steam cycle, a relatively constant level of condensate may be maintained in the hotwell. From the hotwell 40, the condensate is then returned and flows back to the steam generator 20 via a series of condensate and boiler feed pumps (not shown). This completes the normal operation closed flow loop.

During power plant startup or a unit shutdown operating condition, main steam flow to the turbine 21 must be interrupted and bypassed. Referring to FIG. 1, the main steam stop or shutoff valve 24 is closed and bypass valve 25 in the bypass steam header 23 is opened. Energy in the diverted superheated steam from the steam generator 20 must be dissipated before dumping the steam into the condenser 30. Accordingly, the bypass steam flows through the bypass steam header 23 to a desuperheating station. The desuperheating station in one embodiment comprises a desuperheating pressure reducing valve (PRV) 50. Desuperheating PRV 50 is configured to both: (1) reduce the pressure of the bypass steam via the valve internals; and (2) receive and inject cooling water into the superheated bypass steam flow. The high pressure and temperature superheated steam vapor enters the main branch of the valve, is reduced in pressure first, and then the coolant is injected. Such desuperheating PRVs are commercially available from a number of commercial sources, such as without limitation Copes-Vulcan of McKean, Pa. or others.

The injected cooling water, which preferably is condensate in some embodiments, cools the superheated steam as the flow continues in the bypass header 23 towards the condenser 30. The bypass steam stream may therefore contain entrained water droplets, which will gradually evaporate provided sufficient residence time in the bypass header According to one aspect of the present invention, the bypass steam downstream of the desuperheating PRV 50 flows to the bypass steam conditioning device 100 prior to entering the interior region 33 of the condenser, thereby providing sufficient residence time to fully evaporate any residual entrained water droplets.

Figure 4:
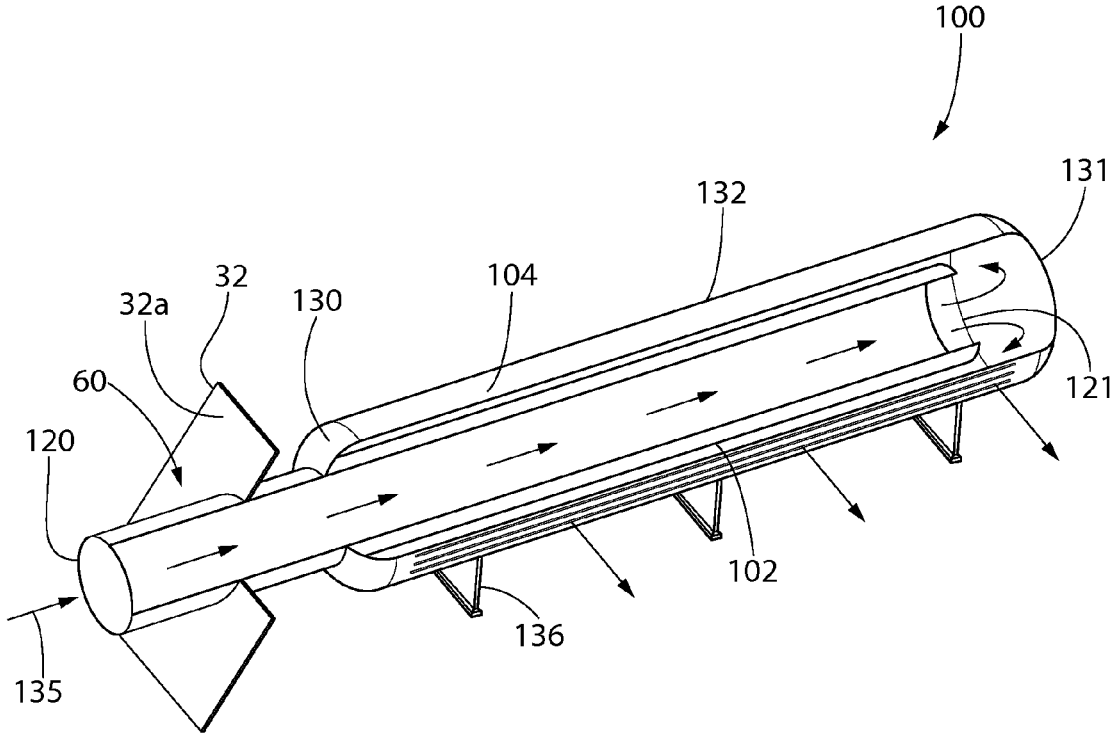
FIG. 4 is a partial perspective view thereof.

Referring now initially to FIGS. 3 and 4, bypass steam conditioning device 100 is elongated in construction and comprises an assembly including inner evaporative core 102 and outer shell 104. In one embodiment, the inner evaporative core 102 comprises a straight hollow tubular body which may be formed of a piping section of suitable thickness T1, axial length L1, and external diameter D1. The core 102 includes a first terminal inlet end 120, opposing second terminal end 121, and longitudinally extending cylindrical sidewalls 122 extending between the ends parallel to a longitudinal axis LA defined by the core. The core 102 defines an open internal flow pathway 123 between ends 120, 121.

The bypass steam conditioning device 100 may be disposed proximate to and includes at least a portion of which penetrates the dome 32 of the condenser in a preferred embodiment to avoid interference with the heat transfer tubes 34 in the lower shell 31, and to introduce and mix the bypass steam flow into the steam space formed above the tubes in the dome. In one embodiment, the majority of the bypass steam conditioning device 100 and the outer shell 104 may be disposed inside the dome of the condenser as shown in FIGS. 3 and 4. In such an arrangement, the inner evaporative core 102 may penetrate the dome sidewall plate 32*a*. Inlet end 120 is disposed outside (externally to) the condenser 30 on the same side as the exterior surface 60 of the condenser. Contrarily, the outlet end 120 may be disposed inside (internally in) the condenser on the same side as the interior surface 61. Terminal inlet end 120 is arranged and configured for fluid connection to the bypass steam header 23. High pressure and temperature steam piping such as the bypass header is generally covered by the ASME (American Society of Mechanical Engineers) B31.1 power piping code. In one embodiment, inlet end 120 may have a weld joint end preparation.

In the embodiment shown, the core 102 and its longitudinal axis LA may be oriented parallel to a horizontal reference plane Ha defined by the condenser dome 32. In other embodiments, the core 102 and its longitudinal axis LA may be obliquely oriented in relation to the horizontal reference plane Ha.

With continuing reference to FIGS. 3 and 4, the outer shell 104 has an axially elongated body extending in the direction of the longitudinal axis LA. In one embodiment, outer shell 104 is concentrically aligned with the inner evaporative core 102. Outer shell 104 includes a first head 130 at first end, opposing second fully closed head 131 at a second end, and longitudinally extending cylindrical sidewalls 132 extending between the heads. The first head 130 may be partially closed, as further described herein. The outer shell 104 has an axial length L2, internal diameter D2, and thickness T2. Outer shell 104 defines an internal cavity 134 that receives at least a portion of inner evaporative core 102 therein. Accordingly, the internal diameter D2 of the outer shell is larger than the external diameter D1 of the inner evaporative core.

A longitudinally extending annular space 133 is formed between the inner evaporative core 102 and outer shell 104. More specifically in one embodiment, the annular space 133 is formed between the sidewalls 122 and 132 of the inner evaporative core 102 and outer shell 104, respectively. The annular space 133 forms a space arranged to receive bypass steam flow from the inner core 102. The size of the annular space is preferably designed and sized to avoid creating unduly high steam velocities within the bypass steam conditioning device 100. In one arrangement, the terminal outlet end 120 of the inner evaporative core 102 is spaced apart from the fully closed head 131 by an axial distance X1 measured from the farthest point on the head 131 to the outlet end 120. This creates an entrance flow reversal plenum 138 for bypass steam to initially enter from the outlet end 120 of the inner evaporative core 102 into the interior cavity 134 of the outer shell 104. In one embodiment as shown in FIG. 3, the annular space 133 may be uniform in size (i.e. substantially same transverse distance between the inner evaporative core 102 and outer shell 104) for promoting even distribution of the steam throughout the outer shell 104.

The outer shell 104 of the bypass steam conditioning device defines a cylindrically shaped hollow pressure vessel designed to handle the pressure and temperature of incoming bypass steam, and uniformly distributes the steam to the interior region 33 of the condenser 30 inside the dome 32. In one embodiment, the heads 130, 131 of outer shell 104 thus form end caps which may have any suitable shape. Examples of shapes that may be used include for example without limitation preferably curved or dished heads (in transverse cross section) such as hemispherical (see, e.g. FIG. 3), ellipsoidal, semi-elliptical and torispherical, and less preferable but still suitable flat heads. The curved heads are preferred to distribute and transition the steam flow more smoothly from inner evaporative core 102 into the annular space 133 of the outer shell, and thereby minimize turbulences within the outer shell. The heads 130, 131 heads may be hermetically seal welded onto the cylindrical sidewall 132 (i.e. body) of the outer shell 104. As shown in FIGS. 3 and 4, head 130 of the outer shell is penetrated by the tubular piping section of inner evaporative core 102 which may be hermetically seal welded directly onto the tubular section (i.e. sidewalls 122) to close off the internal cavity 134 of the outer shell.

The sparger 110 comprising an array of multiple holes or orifices 110*a* may be disposed in the sidewall 132 of the outer shell 104 in one embodiment to direct bypass steam flow to exit the bypass steam conditioning device 100 transversely to the longitudinal axis LA and axial steam flow direction in the inner evaporative core 102. The sparger 110 with its orifices 110*a* is in fluid communication with the annular space 133 of the outer shell and the interior region 33 of the condenser 30. The orifices 110*a* may have any suitable diameter and be arranged in any suitable pattern. Furthermore, the orifices 110*a* may extend circumferentially and axially for any suitable distance. Accordingly, the size, arrangement, and extent of the orifices 110*a* on the sidewall 132 of the outer shell 104 are not limiting of the invention.

With continuing reference to FIGS. 3 and 4, a bypass steam flow path is created by the bypass steam conditioning device 100 in which the outer shell 104 is arranged to receive steam introduced in an axial direction from the inner evaporative core 102, reverse direction 180 degrees within the shell, and then discharge the steam transversely through the sparger 110 into the interior region 33 of the condenser 30. The flow path is shown by the direction flow arrows 135.

The outer shell 104 of the bypass steam conditioning device 100 may supported at least partially by the dome plate 32*a* of the condenser 30, and in some embodiments further by one or more structural supports 136 attached to any suitable interior structure of the condenser. Supports 136 may be axially spaced apart at appropriate intervals. Other forms of support such as hangers may be used in addition to or instead of the support arrangement shown.

The inner evaporative core 102 and outer shell 104 of the bypass steam conditioning device 100 may be formed of any suitable metal which can withstand the bypass steam temperature and pressure conditions. The thickness T1 and T2 may be selected commensurate with these design conditions. In one embodiment, the inner evaporative core 102 and outer shell 104 may be formed of suitable grade of steel or steel alloy.

The lengths L1 and L2 of the inner evaporative core 102 and outer shell 104 respectively may preferably be selected to provide sufficient residence time to fully evaporate any entrained water droplets that may be present in the bypass stream flow downstream of the desuperheating PRV 50 between the valve and condenser 30. It is well within the ambit of one skilled in the art to properly size the bypass steam conditioning device to achieve that design criteria.

Figure 5:
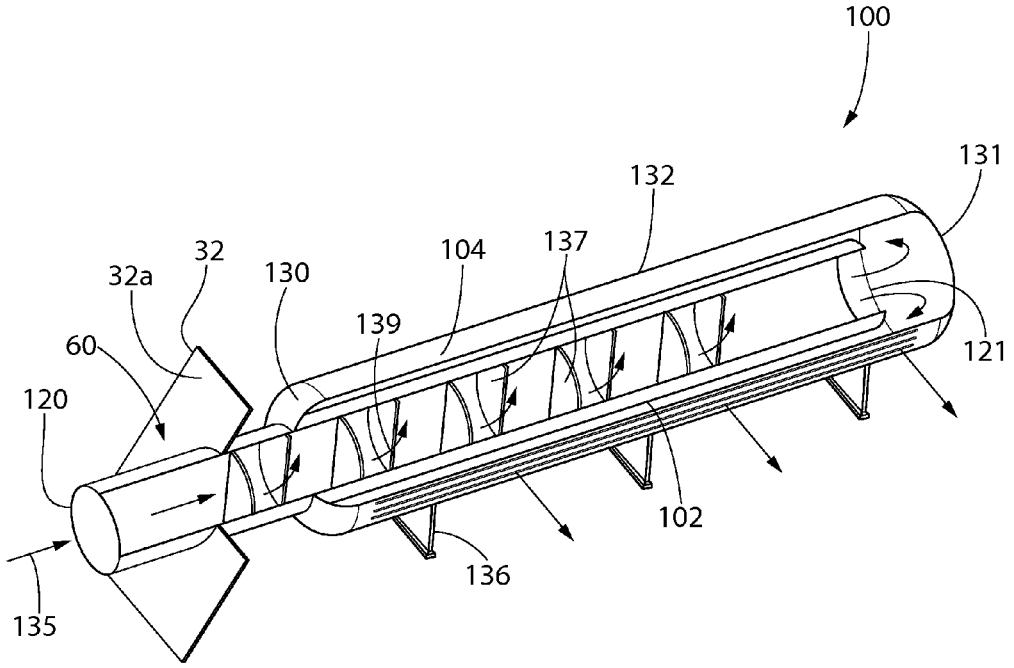
FIG. 5 is a partial perspective view thereof including flow baffles.

According to another aspect of the present invention shown in FIG. 5, a plurality of longitudinally (axially) spaced apart flow baffles 137 may be disposed within the inner evaporative core 102 to further increase the available flow length and the flow turbulence to achieve an optimal combination of evaporative heat transfer rate and residence time within the device. The baffles are arranged to produce a steam cross flow pattern (see direction arrows 139) that increases the residence time of the steam in the inner evaporative core. The baffles 137 may be vertically oriented as shown in one non-limiting embodiment. The baffles 137 may further be attached to opposing lateral sidewalls 122 in a laterally staggered and alternating pattern as shown in one non-limiting example to produce the cross flow. The baffles may have any suitable shape and spacing that increases the residence time of the steam flow through the inner core.

Figure 6:
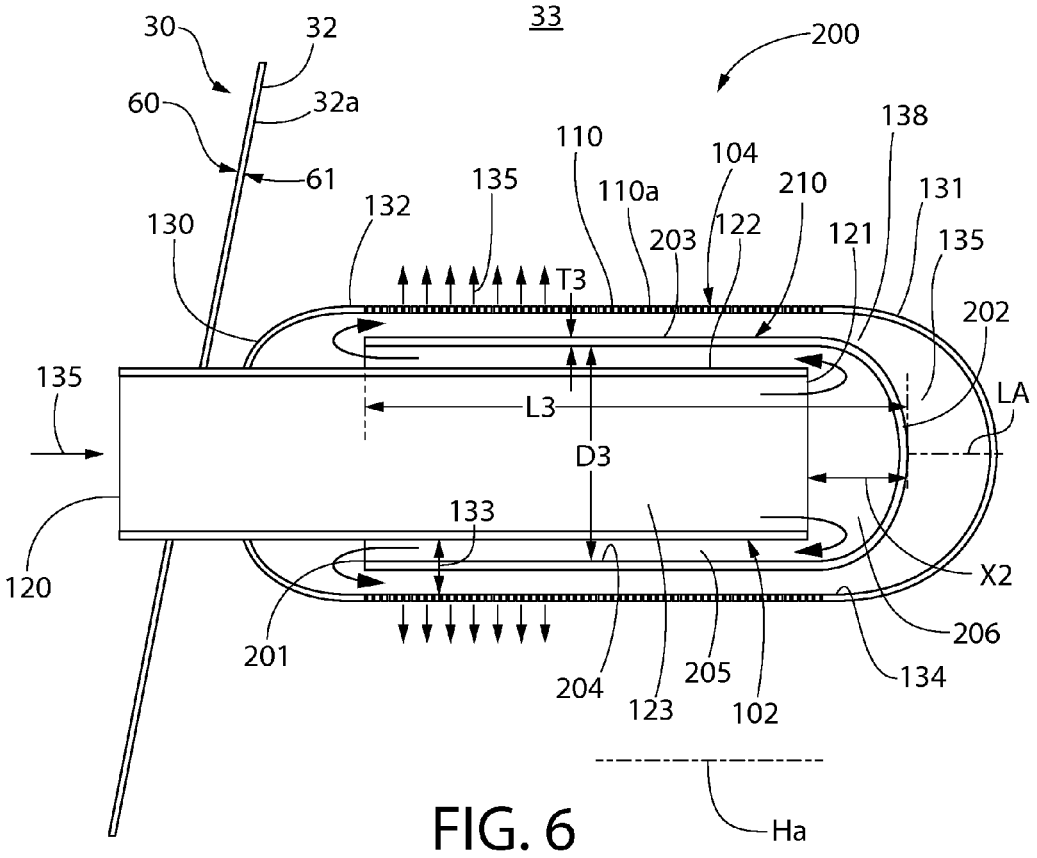
FIG. 6 is a longitudinal cross-sectional elevation view of a second embodiment of the steam conditioning device of FIGS. 1 and 2 which includes an annular shroud.

FIG. 6 illustrates an alternate embodiment of a bypass steam conditioning device 200 having a dual inner core to further increase the available flow length and the flow turbulence to achieve an optimal combination of evaporative heat transfer rate and residence time within the device. The first inner evaporative core 102 and outer shell 104 have essentially the same configuration shown in FIG. 3 and described herein. In this embodiment, however, a second core in the form of a hollow cylindrical annular shroud 210 is interposed between the inner evaporative core 102 and outer shell 104.

Shroud 210 has an axially elongated body extending in the direction of the longitudinal axis LA. Shroud 210 includes a first open end 201, opposing closed head 202, and longitudinally extending cylindrical sidewalls 203 extending between the ends. Head 202 forms a head preferably having a curved or dished shape similar to fully closed head 131 of outer shell 104 described above for the same reasons. The shroud 210 has an axial length L3, internal diameter D3, and thickness T3. Outer shell 104 defines an internal cavity 205 that receives at least a portion of inner evaporative core 102 therein. Accordingly, the internal diameter D3 of the shroud 210 is larger than the external diameter D1 of the inner evaporative core.

A second longitudinally extending annular space 204 is formed between the inner evaporative core 102 and shroud 210. More specifically in one embodiment, the annular space 204 is formed between the sidewalls 122 and 203 of the inner evaporative core 102 and shroud 210, respectively. The annular space 204 forms a space arranged to receive bypass steam flow from the inner core 102. The terminal outlet end 121 of the inner evaporative core 102 is spaced apart from head 202 by an axial distance X2 which forms a flow reversal plenum 206.

During operation, bypass steam flow enters the inner evaporative core 102 and axially enters the shroud 210 in a first direction, reverses direction 180 degrees flowing backward through annular space 205 in a second opposite direction, exits the shroud and axially enters the outer shell 104, reverses direction again 180 degrees flowing forward into the annular space 133 of the outer shell, and leaves the outer shell through sparger 110 flowing into the condenser 30 (see directional steam flow arrows 135). This flow path increases the residence time to fully evaporate any entrained water droplets in the bypass steam flow downstream of the desuperheating PRV 50.

Use of multiple annular cores/pipes and baffles may be considered independently or together to facilitate completion of the evaporative cooling process within the available geometric envelope constraints and within the pressure drop considerations for the sparger design used to ensure the safe entry of steam into the condenser dome space Although FIGS. 3 and 6 show the bypass steam conditioning device 100 mounted inside the condenser 30, other mounting options are possible where there might be insufficient room inside the condenser neck or dome 32 to accommodate the device due to presence of feedwater heaters, piping, or other appurtenances.

Accordingly, FIG. 7 shows an alternate external mounting option and slightly modified dual annular core bypass steam conditioning device 300 which is located outside of the condenser 30. The device has a similar construction in all aspects to the dual annular core shown in FIG. 6 with an intermediate shroud 210, with a few exceptions described below. Discussion of the aspects of bypass steam conditioning device 300 which are similar to those of FIG. 6 will not be repeated here.

Referring now to FIG. 7, the fully closed head 131 of the outer shell 104 in device 300 is instead replaced by a partially closed head 301 having a flow opening 302 formed therein. Opening 302 may be concentrically aligned with the outer shell 14 and longitudinal axis LA in one embodiment. In one configuration, head 301 preferably has a curved or dished shape, which may be of the types already described herein with respect to head 131 of the outer shell 104. Flow opening 302 is in fluid communication with a piping extension 303 that extends axially from the outer shell 104 towards and penetrating the dome plate 32*a* of the condenser 30. Piping extension 303 may have any suitable diameter and includes a first end 305 fluidly connected to the head 301 of the outer shell 104 and an opposing second open end 304 disposed inside the condenser 30 within the dome 32. In one embodiment, piping extension 303 is concentrically aligned with the outer shell 104. A circular shaped sparger 110 of the type and design already described herein is disposed on end 304. The outer shell 104 in this embodiment does not have a sparger due to its location outside of the condenser.

In operation, the bypass steam flow travels in the flow path shown by the directional steam flow arrows 135 in FIG. 7. The steam flow flows into the inner evaporative core 102, axially enters the shroud 210 in a first direction, reverses direction 180 degrees flowing backward through annular space 205 in a second opposite direction, exits the shroud and axially enters the outer shell 104, and reverses direction again 180 degrees flowing forward into the annular space 133 of the outer shell towards open end 301 of the outer shell 104. The steam travels through the piping extension 303 and is discharged into the interior region 33 of the condenser 30 through sparger 110.

It will be appreciated that although the steam conditioning system formed by the steam conditioning device 100 has been described has been described with respect to application in a condenser of a steam generating power plant, the invention is not so limited and has broader applicability to other types of systems and applications beyond that non-limiting example. Moreover, the steam conditioning device 100 further has broader applicability for conditioning steam in other than the bypass steam application disclosed herein as one non-limiting example.

While the foregoing description and drawings represent some example systems, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A steam conditioning system comprising:

a condenser defining an interior region;

a steam conditioning device comprising an assembly of:

an inner evaporative core comprising a tubular section defining a longitudinal axis, the tubular section including an inlet end configured for coupling to a steam piping header and a terminal outlet end; and an outer shell formed around the inner evaporative core, the outer shell including a first head, an opposing closed second head, cylindrical sidewalls extending between the first and second heads, and an internal cavity receiving the inner evaporative core at least partially therein through the first head;

a longitudinally extending annular space formed between the inner core and outer shell;

wherein the outer shell is in fluid communication with the condenser and arranged to receive steam from the inner core and discharge the steam into the interior region of the condenser.

2. The system according to claim 1, further comprising a sparger formed in the outer shell of the steam conditioning device, the sparger comprising a plurality of orifices in fluid communication with the annular space of the outer shell and the interior region of the condenser, wherein the sparger creates a flow path configured to receive steam from the inner core and discharge the steam through the sparger into the interior region of the condenser.

3. The system according to claim 2, wherein the steam is received into the outer shell from the inner evaporative core in an axial direction parallel to the longitudinal axis and discharged through the sparger in a transverse direction to the longitudinal axis.

4. The system according to claim 1, wherein the condenser includes a shell and a dome that collectively define the interior region, at least a portion of the steam conditioning device being disposed inside the dome.

5. The system according to claim 4, wherein outer shell is completely disposed inside the dome of the condenser.

6. The system according to claim 5, wherein the inlet end of the tubular section of the steam conditioning device is disposed outside the condenser and the outlet end is disposed in the outer shell and inside the condenser, the tubular section extending completely ough a plate forming the dome of the condenser.

7. The system according to claim 1, wherein the first head of outer shell is seal welded to the tubular section of the inner evaporative core, the tubular section penetrating the first head and extending into the internal cavity of the outer shell.

8. The system according to claim 7, wherein the second head of the outer shell is axially spaced apart from the outlet end of the tubular section to define an entrance flow plenum for receiving steam from the inner evaporative core.

9. The system according to claim 1, wherein the first and second heads of the outer shell have a curved or dished configuration.

10. The system according to claim 1, wherein the annular space is dimensionally uniform in a transverse direction.

11. The system according to claim 1, further comprising a plurality of axially spaced apart flow baffles disposed in the tubular section of the inner evaporative core, the baffles arranged to produce a steam cross flow pattern that increases the residence time of the steam in the inner evaporative core.

12. The system according to claim 1, further comprising:

a desuperheating pressure reducing valve configured to receive and reduce the pressure of an inlet steam flow and inject a liquid coolant into the steam flow to cool a temperature of the steam flow; and a piping header fluidly connecting the valve to the inlet end of the inner evaporative core.

13. The system according to claim 1, further comprising a plurality of heat exchange elements disposed in the interior region of the condenser which are operable to condense steam.

14. A steam conditioning system, the system comprising:

a condenser defining an interior region;

a steam conditioning device comprising an assembly of:

an inner evaporative core comprising a tubular section defining a longitudinal axis, the tubular section including an inlet end configured for coupling to a steam piping header and a terminal outlet end; and an outer shell formed around the inner evaporative core, the outer shell including a first head, an opposing closed second head, cylindrical sidewalls extending between the first and second heads, and an internal cavity receiving the inner evaporative core at least partially therein through the first head;

a longitudinally extending first annular space formed between the inner core and outer shell;

a hollow cylindrical annular shroud disposed in the internal cavity of the outer shell, the shroud including an open end and an opposing closed third head that defines a flow plenum, the inner evaporative core at least partially inserted into the shroud which is arranged to receive steam from the inner evaporative core;

a longitudinally extending second annular space formed between the inner core and annular shroud, the second annular space in fluid communication with the inner evaporative core and the internal cavity of the outer shell;

an interconnected steam flow path formed between the inner evaporative core, annular shroud, and outer shell;

wherein the outer shell is in fluid communication with the condenser and arranged to receive steam from the inner core via the annular shroud, and discharge the steam into the interior region of the condenser.

15. The system according to claim 14, further comprising a sparger formed in the outer shell of the steam conditioning device, the sparger comprising a plurality of orifices in fluid communication with the first and second annular spaces and the interior region of the condenser.

16. The system according to claim 15, wherein the steam flow path is configured so that steam is received into the annular shroud outer shell from the inner evaporative core in a first axial direction parallel to the longitudinal axis, the steam reverses direction and flows backwards in a second axial direction parallel to the longitudinal axis within the annular shroud, and discharges through the sparger into the condenser in a transverse direction to the longitudinal axis.

17. The system according to claim 14, wherein the condenser includes a shell and a dome that collectively define the interior region, at least a portion of the steam conditioning device being disposed inside the dome.

18. The system according to claim 17, wherein the outer shell is completely disposed inside the dome of the condenser.

19. The system according to claim 14, wherein the first head of outer shell is seal welded to the tubular section of the inner evaporative core, the tubular section penetrating the first head and extending into the internal cavity of the outer shell.

20. The system according to claim 14, wherein the steam conditioning device is disposed outside the condenser, and further comprising a piping extension extending from the outer shell and in fluid communication with the interior region of the condenser, the piping extension arranged to discharge steam from the outer shell into the condenser.

21. The system according to claim 20, wherein the piping extension is fluidly coupled to the third head of the annular shroud and forms a flow opening for receiving steam from the internal cavity of the outer shell.

22. A method for discharging steam into a condenser, the method comprising:

providing an axially elongated steam conditioning device including a tubular shaped inner evaporative core having an inlet end and an opposite outlet end disposed inside a cylindrical outer shell having a first head and an opposite second head, the steam conditioning device defining a longitudinal axis and axial direction;

the inlet end of the evaporative core receiving steam from a desuperheating pressure reducing station;

discharging the steam from the inner evaporative core through the outlet end into an internal cavity of the outer shell; and discharging the steam from the outer shell into the condenser.

23. The method according to claim 22, wherein the steam is discharged from the outer shell transversely to the longitudinal axis into the condenser.

24. The method according to claim 22, wherein the steam is discharged from the outer shell into the condenser through a piping extension fluidly coupled to the second head of the outer shell.

* * * * *